United States Patent [19]

Savard et al.

[11] Patent Number: 4,509,595

[45] Date of Patent: Apr. 9, 1985

[54] IN SITU COMBUSTION FOR OIL RECOVERY

[75] Inventors: Guy Savard, Westmount; Robert G. H. Lee, Montreal, both of Canada

[73] Assignee: Canadian Liquid Air Ltd/Air Liquide, Montreal, Canada

[21] Appl. No.: 341,677

[22] Filed: Jan. 22, 1982

[30] Foreign Application Priority Data

Jan. 28, 1981 [CA] Canada ..... 369497

[51] Int. Cl.[3] ..... E21B 43/243; E21B 36/00

[52] U.S. Cl. ..... 166/261; 166/57

[58] Field of Search ..... 166/256, 260, 261, 57

[56] References Cited

U.S. PATENT DOCUMENTS

| | | | |
|---|---|---|---|
| 2,148,717 | 2/1939 | Whitney | 166/57 X |
| 2,722,277 | 11/1955 | Crawford | 166/260 |
| 2,994,375 | 8/1961 | Hurley . | |
| 3,007,520 | 11/1961 | Frey . | |
| 3,019,838 | 2/1962 | Harlan et al. | 166/260 |
| 3,126,960 | 3/1964 | Woodward et al. | 166/256 |
| 3,180,411 | 4/1965 | Parker | 166/256 |
| 3,196,945 | 7/1965 | Craig, Jr. et al. | 166/261 |
| 3,208,519 | 9/1965 | Moore | 166/261 |
| 3,438,437 | 4/1969 | Christofferson | 166/57 |
| 3,441,083 | 4/1969 | Fitzgerald | 166/245 |
| 3,457,995 | 7/1969 | Cornelius et al. | 166/260 |
| 3,473,610 | 10/1969 | Lange | 166/261 |
| 4,042,026 | 8/1977 | Pusch et al. | 166/261 X |
| 4,099,567 | 7/1978 | Terry | 166/261 |
| 4,147,213 | 4/1979 | Hollingsworth | 166/256 |
| 4,274,487 | 6/1981 | Hollingsworth et al. | 166/261 |

FOREIGN PATENT DOCUMENTS 1473669 2/1967 France .

*Primary Examiner*—George A. Suchfield

*Attorney, Agent, or Firm*—Browdy and Neimark

[57] ABSTRACT

An oil recovery installation made up of an inner conduit for an oxidant gas and a surrounding outer conduit forming therebetween a water jacket for cooling liquid leading from an upper end at the surface through a sealing well casing to a lower end within the underground oil recovery formation. Terminal means closes the lower end of the outer conduit and provides a restricted passage in communication with the inner conduit for injecting oxygen into the formation. There is means for supplying oxidant gas under pressure to the upper end of the inner conduit and means for supplying water to circulate within the cooling jacket. There is means for controlling the supply rate of oxidant gas and means for controlling the water supply rate.

13 Claims, 2 Drawing Figures

FIG. I
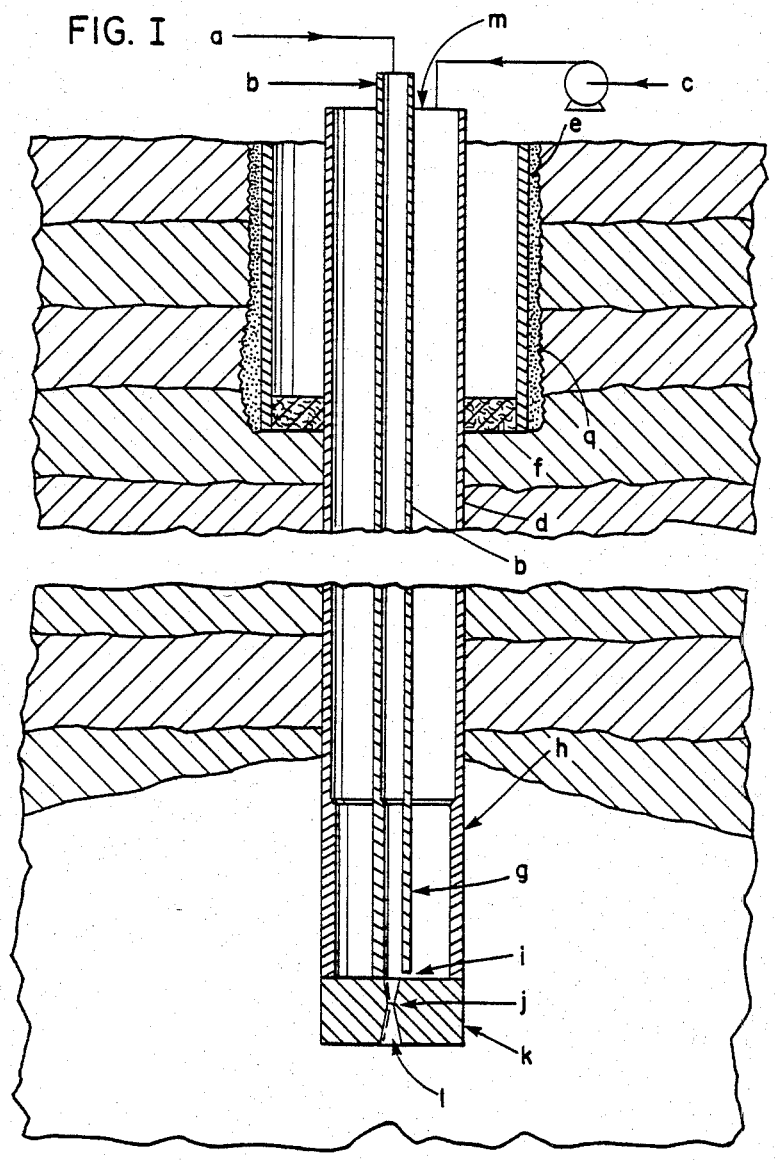

FIG. II
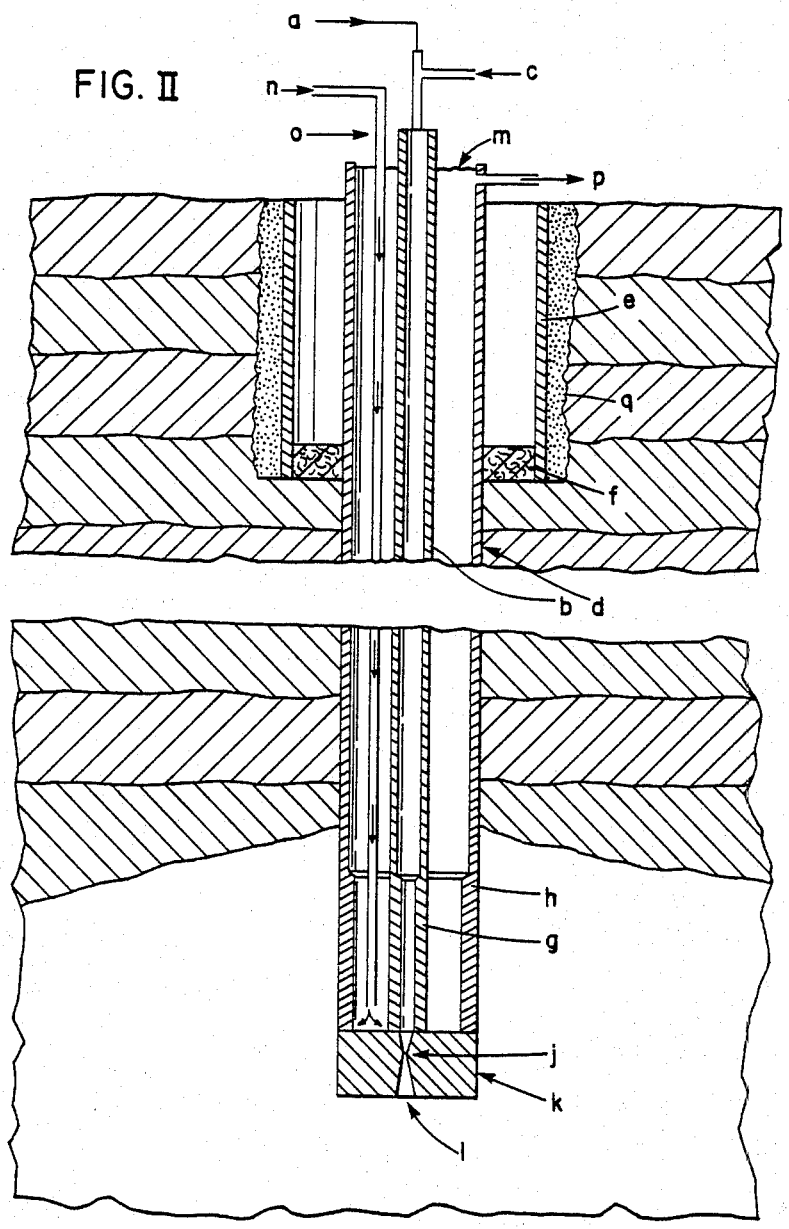

IN SITU COMBUSTION FOR OIL RECOVERY

This invention relates to a method and installation for supplying active fluids to an underground oil-bearing formation during the course of in situ combustion.

The use of air for in situ combustion to provide heat and a drive to recover oil from an underground formation has been practiced for many years.

U.S. Pat. No. 3,208,519, dated Sept. 28, 1965, teaches the use of molecular oxygen, rather than air, to supply the oxidant. Along with molecular oxygen, water (from: 4 to 6 times the weight of oxygen) is simultaneously flowed into the formation to control the flame temperature, to produce a steam drive, and to recover the heat behind the flame front. It was shown that the water is caused to flow into the oil bearing zone at the top of the zone, and that the molecular oxygen is caused to flow into the base of the formation. No consideration has been given to the safety aspects involved with the use of molecular oxygen. For example, one of the hazards of employing molecular oxygen (rather than air) for in situ combustion is that the flame velocity may be as much as 10 times greater as that when using air.

It is also conceivable that, at some time, intense flames can be generated around the injection well, the oxygen pipe as described in U.S. Pat. No. 3,208,519 may reach a temperature where destruction of the pipe may occur. In a less severe case, the pipe could be deformed or attacked by the heat. It can also be subjected to a sand blasting caused by the turbulence of the unconsolidated sand surrounding the injection well, this agitation caused by the high flow of oxidizing gas. The unprotected oxygen pipe, as described in U.S. Pat. No. 3,208,519, is thus exposed to numerous hazards.

It is an aim of the present invention to provide a method and means for overcoming these problems.

With this in mind, an installation according to the invention is a fluid supply assembly which has the following characteristics. There is an inner conduit for an oxidant gas and a surrounding outer conduit forming between the inner and outer conduits a water passage leading from an upper supply end at the surface of the ground through a sealing well casing to a lower terminal end within the underground oil recovery formation. Terminal means comprising a thick plate closes the lower end of the outer conduit and provides a restricted outlet passage in communication with the inner conduit for injecting oxygen or water or both into the formation. Means are provided for supplying oxidant gas containing more than 30% by volume under pressure to the upper supply end of the inner conduit. Means are also provided for supplying water to the outer passage. There are means for controlling the supply rate of oxidant gas and means for controlling the water supply rate. In one form of the invention the inner passage communicates with the injection passage or outlet and the cooling jacket isolated from it so that only oxygen is injected through the injection outlet. In another embodiment, there is a restricted communication between the terminal end of the outer passage and the inner passage so that both water from the outer passage and oxidizing gas may be injected through the injection outlet. In one arrangement a water conduit leads from the supply end to near the bottom of the outer passage so that water is introduced at the bottom to circulate upwards. In all cases the outer passage serves as a cooling jacket.

A method according to the invention employs an installation, as described, in recovering oil in which there are a number of potential variations including the following. The oxygen-containing gas may be supplied at a pressure such that the velocity at the injection passage is greater than the maximum possible flame velocity. The oxidant gas velocity at the injection passage may be greater than 90 feet per second. During the oxidant gas injection part of the cycle, water may be injected at a reduced flow rate. Water may be injected at a rate less than 25% of the average normal requirement based on a unit of injected oxygen gas. During the water injection cycle, the oxidant gas may be injected at a reduced flow rate. The oxidant gas may be injected at a rate less than 25% of the average normal requirement based on a unit of water.

The invention contemplates that oxygen-containing gas will be molecular oxygen containing more than 30% by volume of oxygen gas. Commercial oxygen may be employed.

"The invention will be further explained by reference to the accompanying drawings and the following examples, keyed to the drawings. In the drawings:

FIG. I is a schematic vertical cross-section through an oil recovery site in which there is shown a preferred installation, according to the invention;

FIG. II is a view similar to FIG. I in which there is an alternative preferred installation.

The drawings show an injection well, which is used to supply oxygen to cause combustion of a potion of the oil in the oil recovery site to cause oil to flow toward an output well (not shown) spaced from the input well. The combustion front is propagated from the input well towards the output well.

FIG. I shows a steel casing e extending from the surface through the overburden with concrete q filling the space between it and the drill hole. An active fluid supply assembly extends through the casing and through the overburden from a supply end at the surface to a terminal end in the oil formation and is made up as follows.

An outer pipe d extends from the surface through the casing and beyond it through a narrower drill hole to a terminal end in the oil-bearing formation. A lower stretch of the pipe d has a thickened wall h. An inner pipe b extends from the surface, concentrically with the pipe d,h to a terminal end level with that of the outer pipe d,h. The lower end of the pipe b has a thickened wall e.

A thick terminal steel plate k is connected to and caps the terminal ends of the pipes d,h and b,g. The plate has a central opening 1 leading from the terminal end of the pipe b,g. The opening 1 has a restricted throat j.

The inner tube b,g provides an inner fluid passage. The pipes b,g and d,h form between them an annular outer fluid passage or jacket m. The terminal end of the pipe b,g is provided with a restricted orifice i leading from the outer fluid passage to the inner fluid passage.

The supply end of the pipe b,g is connected to a source a of oxygen under pressure. The supply end of the outer passage m is connected with a source c of water under pressure.

In accordance with the invention and in the course of in situ combustion, the apparatus is used to supply oxygen and water, as active fluids, under circumstances and conditions described below in more detail.

FIG. II illustrates another arrangement, in accordance with the invention. This arrangement is similar to that of FIG. I and the same reference letters have been given to the same parts. The difference over the structure of FIG. I is that it lacks the passage i, between the outer passage m and the inner passage so only the inner passage communicating with the opening 1 and the chamber m is isolated from it. The supply end of the pipe b,g is connected with a source a of oxygen under pressure as well as with a source c of water under pressure. A pipe n extends from a source of supply of water at the surface to near the terminal end of the outer passage or jacket m. There are appropriate means for controlling the supply of oxygen and water. The supply end of the chamber m has an overflow p.

In accordance with the invention, in the course of in situ combustion, the apparatus may be used to inject oxidant gas or water into the oil-bearing formation, under circumstances and conditions described elsewhere herein in more detail."

The invention will be further described in terms of three exemplary cases.

CASE I

In this case the invention makes it possible to introduce the oxygen and/or water safely through a single opening at the outlet of the injection pipe into the oil bearing formation.

Thus the invention overcomes the hazards by placing the oxygen pipe concentrically inside a larger pipe, and using the resulting annular space for conveying the injected water. This water also serves to cool the large outer pipe and hence minimizes the effects of any severe thermal conditions. Again, this outer pipe serves to protect the oxygen inner pipe from any sand blasting.

Another feature of the present invention is the design of the oxygen outlet from the pipe into the reservoir. The velocity of oxygen is maintained sufficiently great to prevent flame propagation back into the pipe. This is achieved by constricting the oxygen outlet to maintain a minimum velocity of greater than 90 ft/sec.

Still another feature of the invention is the simultaneous injection of water and molecular oxygen into the formation from the same opening, whereby the oxygen atomizes the water to obtain a mist, thereby uniformly mixing the oxygen and water as the mixture flows from the production well into the formation. If continuous, simultaneous and uniform injection of water and molecular oxygen is practiced, the molar ratio of water/oxygen is generally about 9. As long as a flame front can be sustained, the high ratio is the safest method to introduce molecular oxygen into the formation.

A feature of this invention eliminates another hazard. Generally when using air, the pipe conveying the air down the well terminates within the casing creating a confined annular space where explosive mixtures can be contained and where the casing is subjected to the possible hostile environment. The present invention requires that the concentric water cooled injection configuration extends beyond the end of the casing by a substantial distance. For example, the well casing can be terminated at the top of the oil bearing zone and the injection pipe configuration can extend to the base of the oil zone.

CASE II

In the case where it is desirable to alternate between molecular oxygen and water, the injection cycle could be, for example, two-thirds of the time on oxygen and one-third of the time on water. The injection technique is most securely carried out by using the same and only outlet for both the injected fluids. The opening is designed to maintain an oxygen velocity of at least 90 ft/sec. To ensure that no hydrocarbon enters the oxygen tube, water is injected into the reservoir through the same opening. At all times, either oxygen or water is flowing through said opening into the reservoir. This practice ensures that the oxygen pipe cannot become contaminated with hydrocarbon, neither liquid or gaseous.

CASE III

When using molecular oxygen as the oxidant, the greatest hazard occurs generally at the start of the oxygen injection. In the case where alternate injection, as described in Case II, is the desirable sequence, the safety is greatly enhanced by modifying the sequence to enable oxygen and water to flow at all times according to the following practice, for example:

During oxygen injection, water is also introduced at a low flowrate say at about 10 to 20% of the normal rate applied during the water flood. During the water injection cycle, oxygen is also introduced at about 10 to 20% of the normal flowrate. This ensures that the oxygen cycle does not start nor stop but alternates on a high and low configuration. Similarly, the water injection alternates at a low and a high injection rate respectively.

In this practice, the oxygen is flowing continuously and always diluted with some water in the form of a spray or mist. Again, a continuous water flow through the annulus is useful in keeping the outside pipe from overheating.

EXAMPLE I

As an example, for Case I, referred to in FIG. I, molecular oxygen and water are simultaneously, continuously and uniformly injected from the well into the formation, where molecular oxygen flowrate is 200,000 scf/day at 800 psig and the water flowrate is 200 barrel/day. The central tube (b) for the oxygen flow (a) is made of mild steel or stainless steel, schedule 80, ½" nominal pipe size. The last 10 feet of this pipe (g) at the bottom of the well is schedule 160, ½" nominal pipe, either, stainless steel, nickel, monel or other oxidation and heat resistant alloy.

An annular steel pipe (d), schedule 80, 2" nominal size is concentrically placed over the central oxygen pipe for the full length of the well, where the lowest portion, which is within the oil bearing zone, say for example, about 40 ft, is schedule 160, stainless, nickel, monel or other resistant alloys.

These two pipes are joined to a bottom plate (k) constructed with an opening (l) with a throat (j) which gives the molecular oxygen a velocity greater than 90 ft/sec. For example, when the gas pressure is 800 psig and the throat is 0.2" diameter, the velocity is 200 ft/sec. When the throat is 0.28" diameter, the oxygen velocity is about 100 ft/sec. Opening (l), the only opening for the injected fluids to enter the formation. Water is injected into the oxygen stream through a connecting passage (i) which is designed with an orifice of ¼" diameter to obtain a pressure drop of about 5 to 10 psi ensuring that oxygen cannot flow back into the annular space. Again, this component (k) is constructed of material resistant to the exposed environment at the injection well.

EXAMPLE II

This example corresponds to Case II and FIG. II, where oxygen and water are alternately injected into the formation. Assume that molecular oxygen is to be injected at a rate of 300,000 cf/day for two days, followed by injection of 600 barrels of water/day for one day, to complete a three day cycle.

Again the invention requires that the velocity of the molecular oxygen at the throat (j) be greater than 90 ft/sec. For an oxygen velocity, 200 ft/sec and at 800 psig, the throat (j) is 0.24 is diameter. For 100 ft/sec, the throat is 0.34 in diameter. The opening (l) is also used for the injected water into the formation, the water being introduced by the same pipe (b) as for the oxygen. The 0.24" diameter results in a pressure drop of about 250 psi across the opening (l). With a throat diameter of 0.34", results, a pressure drop of about 65 psig occurs across the throat.

If necessary the cooling water in the annular space (m) at the bottom of the well may be circulated by introducing the cooling water to the bottom via pipe (o) and overflowing the return cooling water at the top of the well at outlet (p).

EXAMPLE III

This procedure, corresponding to Case II, is a compromise between Examples I and II and is illustrated in FIG. I. In this example, neither the oxygen nor the water stops flowing. During oxygen injection for two days to fire the flame front, molecular oxygen is injected say at 275,000 scf/day (at 800 psig) while water is injected at a rate of 90 barrel/day. At 800 psig, with an oxygen velocity of 100 ft/sec at the throat (j), the diameter is 0.324". The orifice (i) for the water to flow into the oxygen stream at the only opening (l) situated at the bottom plate (k) is 0.168" diameter to give a pressure of about 5 psi.

During the water flood cycle, water is injected at a rate of 420 barrel/day with the oxygen being simultaneously injected at 50,000 scf/day for one day to complete the 3 day cycle. With the orifice of 0.168" diameter, a pressure drop of 110 psi occurs during the water injection cycle. The overall three day cycle results in the same mass of oxygen and water injected as in Case I; however, the safety feature is that the oxygen and water system operate continuously, thus ensuring that oxygen is always injected with some water, and that during high water injection flowrate, the oxygen pipe is constantly filled with clean oxygen. The continuous flow of water ensures that cooling of the outside concentric 2" pipe always occurs.

The above parameters are given as examples and they are not to restrict the basic invention of shrouding the oxygen pipe with another larger diameter protective pipe and using water cooling in the annular space to further protect the inner oxygen pipe.

The use of molecular oxygen or any reactive oxidant, including air, and oxygen enriched air can also employ the invention to minimize the hazards and to protect the oxygen pipe against the possible hostile environment surrounding the injection well.

The embodiments of the invention in which an exclusive property or privilege is claimed are defined as follows:

1. An oil recovery installation, comprising, an inner fluid conduit forming an inner passage for an active fluid and a surrounding outer conduit forming therebetween an outer fluid passage, both conduits leading from a supply end at the surface to a lower terminal end within the underground oil recovery formation, terminal means comprising a thick plate closing the lower end of the outer and inner conduits and providing a single restricted outlet passage in direct aligned communication with the inner passage for injecting active fluid into the formation, said outlet passage having a restricted throat to increase the velocity of the injected active fluid, means for supplying oxidant gas containing more than 30% oxygen by volume under pressure or water under pressure or both to the supply end of the inner conduit, means for supplying water under pressure to the outer passage, and means for controlling the supply rate of oxidant gas and means for controlling the water supply rate to said outer passage.

2. An installation, as defined in claim 1, in which the lower end of the inner passage is connected to the injection outlet passage and the outer passage isolated therefrom, whereby the active fluid is injected through said inner passage.

3. An installation, as defined in claim 1, including a conduit leading from the surface to near the bottom of the cooling jacket so that water in introduced at the bottom.

4. An oil recovery installation, comprising, an inner conduit for an oxidant gas and a surrounding outer conduit forming therebetween a water jacket for cooling liquid leading from an upper end at the surface through a sealing well casing to a lower end within the underground oil recovery formation, terminal means closing the lower end of the outer conduit and providing a restricted passage in communication with the inner conduit for injecting oxygen into the formation, means for supplying oxidant gas under pressure to the upper end of the inner conduit, means for supplying water to circulate within the cooling jacket, and means for controlling the supply rate of oxidant gas and means for controlling the water supply rate, the inner conduit being connected to the injection passage and there being a communication between the jacket and the injection passage so that both water and oxidizing gas may be injected.

5. An installation, as defined in claim 4, in which the communication is an orifice in said inner conduit adjacent to said terminal means.

6. A method of recovering oil from an underground formation by combustion of oil in situ in which an active fluid comprising combustion supporting oxidant gas containing more than 30% oxygen by volume and water are flowed into the formation to control the flame temperature, to produce steam drive, and to recover heat behind the flame front, comprising supplying the oxidant gas through a passage formed by an inner conduit leading from a supply end at the surface to an injection end in the oil-containing formation, surrounding the inner conduit with water flowed through an outer passage surrounding the inner conduit from the surface of the formation, supplying water as an active fluid to the injection end of the inner passage, passing the active fluid from the bottom of the inner passage through a single restricted injection passage aligned with the end of the inner passage and provided with a venturi throat into the formation at a velocity greater than the maximum possible flame velocity in the formation.

7. A method, as defined in claim 6, in which the inner conduit is connected to the injection passage and isolated from the outer passage, whereby only active fluid supplied to the supply end of said inner conduit is injected through said restricted passage.

8. A method, as defined in claim 7, in which the water flowed through the outer passage is introduced near the bottom of the outer passage and overflows at the surface.

9. A method, as defined in claim 6, in which the inner conduit is connected to the injection passage and there is a channel from the outer passage to the bottom of the inner passage so that the water injected into the formation is supplied from the outer passage to the bottom of the inner passage.

10. A method, as defined in claim 6, in which the oxidant gas velocity at the injection passage is greater than 90 feet per second.

11. A method, as defined in claim 6, wherein both oxidant gas and water, as active fluids, are injected in alternately respectively predominant amounts in cycles and during the oxidant gas injection predominent part of the cycle, water is injected at a reduced flow rate and during the water injection predominant part of the cycle oxidant gas is injected at a reduced flow rate.

12. A method, according to claim 11, wherein during the oxidant gas predominant part of the cycle water is injected at a rate less than 20% of the normal amount injected during the water predominant part.

13. A method, according to claim 11, wherein during the water predominant part of the cycle the oxidant gas is injected at a rate less than 20% of the normal amount injected during the oxidant gas predominant part of the cycle.

* * * * *